US010753694B2

(12) United States Patent
Unger

(10) Patent No.: US 10,753,694 B2
(45) Date of Patent: Aug. 25, 2020

(54) PORTABLE FIREARM RECEIVER HAVING FRONT AND REAR LOCKING ASSEMBLIES FOR REMOVABLE RECEIVER COVER

(71) Applicant: Sebastian Josef Unger, Wolfsgraben (AT)

(72) Inventor: Sebastian Josef Unger, Wolfsgraben (AT)

(73) Assignee: Sebastian Unger, Wolfsgraben (AT)

( * ) Notice: Subject to any disclaimer, the term of this patent is extended or adjusted under 35 U.S.C. 154(b) by 0 days.

(21) Appl. No.: 16/122,047

(22) Filed: Sep. 5, 2018

(65) Prior Publication Data

US 2019/0234700 A1 Aug. 1, 2019

Related U.S. Application Data

(60) Provisional application No. 62/623,671, filed on Jan. 30, 2018.

(51) Int. Cl.

| | |
|---|---|
| ***F41A 3/66*** | (2006.01) |
| ***F41A 11/02*** | (2006.01) |
| ***F41G 11/00*** | (2006.01) |
| ***F41A 11/00*** | (2006.01) |

(52) U.S. Cl.

CPC ..... *F41A 11/02* (2013.01); *F41A 3/66* (2013.01); *F41A 11/00* (2013.01); *F41G 11/003* (2013.01)

(58) Field of Classification Search

CPC .... F41A 3/66; F41A 3/72; F41A 17/38; F41A 11/00; F41A 19/31

USPC ..... 42/6, 75.03, 75.01, 75.02

See application file for complete search history.

(56) References Cited

U.S. PATENT DOCUMENTS

| | | | | | |
|---|---|---|---|---|---|
| 1,370,118 | A * | 3/1921 | Johnson | F41A 21/484 | 42/75.01 |
| 1,430,661 | A * | 10/1922 | Lewis | F41A 3/26 | 89/193 |
| 2,090,340 | A * | 8/1937 | Browning | F41A 5/02 | 89/139 |
| 2,112,660 | A * | 3/1938 | Hudson | F41A 3/46 | 89/149 |
| 2,173,576 | A * | 9/1939 | Brewer | F41A 3/12 | 42/16 |
| 2,223,092 | A * | 11/1940 | Brewer | F41A 3/12 | 42/16 |

(Continued)

*Primary Examiner* — Michael D David

(74) *Attorney, Agent, or Firm* — Jordan IP Law, LLC; Todd A. Vaughn

(57) ABSTRACT

A firearm receiver includes a receiver housing defining an annular region to receive a bolt of the firearm, and a receiver cover removeably connected to the receiver housing. A guide assembly facilitates movement of the receiver cover relative to the receiver housing between an operating position to cover the annular region, and a non-operating position to expose the annular region and thereby facilitate access to the annular region. Locking assemblies are to facilitate a secure connection between the receiver housing and the receiver cover at the front and the rear of the receiver. The locking assemblies ensure that the receiver cover is securely maintained on the receiver housing during the firing of the firearm, and also enhances the overall structural integrity of the receiver during the firing of the firearm due to the fact the force of the bolt during firing of the firearm is distributed between the receiver housing and the receiver cover.

15 Claims, 14 Drawing Sheets

(56) References Cited

U.S. PATENT DOCUMENTS 2,237,601 A * 4/1941 Holek ..... F41A 3/22 42/16
2,330,737 A * 9/1943 Pedersen ..... F41A 3/26 42/50
2,364,549 A * 12/1944 Pedersen ..... F41A 19/11 42/75.01
2,425,412 A * 8/1947 Barnes ..... F41A 9/19 89/145
2,447,091 A * 8/1948 Pope ..... F41A 11/00 42/76.01
2,466,902 A * 4/1949 Lochhead ..... F41A 3/32 89/182
2,594,861 A * 4/1952 Browning ..... F41A 5/02 42/75.03
2,679,123 A * 5/1954 Williams ..... F41A 11/00 42/75.02
2,685,754 A * 8/1954 Crittendon ..... F41C 7/02 42/16
3,150,458 A * 9/1964 Browning ..... F41A 21/488 42/75.02
3,584,533 A * 6/1971 Allyn ..... F41A 3/54 89/144
3,711,983 A * 1/1973 Allyn ..... F41A 3/54 42/75.03
4,109,403 A * 8/1978 Badali ..... F41A 21/484 42/75.02
4,416,186 A * 11/1983 Sullivan ..... F41A 3/26 89/198
4,475,437 A * 10/1984 Sullivan ..... F41A 3/72 42/70.06
4,502,367 A * 3/1985 Sullivan ..... F41A 3/72 89/181
4,505,182 A * 3/1985 Sullivan ..... F41A 3/72 89/132
4,964,232 A * 10/1990 Mainland ..... F41A 3/58 42/44
6,526,683 B1 * 3/2003 Crandall ..... F41A 19/09 42/40
7,444,775 B1 * 11/2008 Schuetz ..... F41A 9/71 42/49.02
8,910,406 B1 * 12/2014 Huang ..... F41A 3/66 42/16
9,194,638 B2 * 11/2015 Larson, Jr. ..... F41A 17/38
9,618,284 B1 * 4/2017 Hoffman ..... F41A 7/08
10,260,829 B1 * 4/2019 Wright ..... F41A 11/02
2009/0277067 A1 * 11/2009 Gregg ..... F41A 3/66 42/69.01
2009/0288324 A1 * 11/2009 Peterson ..... F41C 23/20 42/75.03
2013/0227869 A1 * 9/2013 Thordsen ..... F41C 27/00 42/6
2015/0330733 A1 * 11/2015 DeSomma ..... F41A 3/66 42/6
2017/0023320 A1 * 1/2017 Barrett ..... F41A 3/66
2017/0023333 A1 * 1/2017 Faifer ..... F41A 3/66
2017/0160037 A1 * 6/2017 Gray ..... F41A 21/482
2017/0198994 A1 * 7/2017 Grier ..... F41F 1/08
2017/0227312 A1 * 8/2017 Christensen ..... F41A 3/66
2017/0299292 A1 * 10/2017 Daley, Jr. ..... F41A 11/00
2018/0031343 A1 * 2/2018 Caudle ..... F41A 11/02
2019/0234700 A1 * 8/2019 Unger ..... F41A 3/66

* cited by examiner

PORTABLE FIREARM RECEIVER HAVING FRONT AND REAR LOCKING ASSEMBLIES FOR REMOVABLE RECEIVER COVER

CROSS-REFERENCE TO RELATED APPLICATIONS

This application claims priority to U.S. Provisional Patent Application No. 62/623,671 (filed on Jan. 30, 2018), which is hereby incorporated by reference in its complete entirety.

TECHNICAL FIELD

Embodiments relate to a portable firearm, such as, for example, pistols and shoulder-fired firearms (e.g., rifles, carbines, shotguns, submachine guns, and machine carbines) having a receiver. Such a receiver includes a removeable receiver cover that does not require the entire removal of the receiver in order to gain access to components (e.g., the bolt mechanism of the firearm) for disassembly and/or cleaning. The receiver cover, when removed (i.e., in a non-operating position) from the receiver housing, exposes an internal region to facilitate access to components (e.g., the bolt of the firearm). The receiver cover, is securely positioned (i.e., in an operating position) on the receiver housing via a first locking assembly at a front/forward region of the receiver and a second locking assembly at an aft/rear region of the receiver. The first and second locking assemblies ensures that the receiver cover is securely maintained on the receiver housing during the firing of the firearm. The first and second locking assemblies further ensures the overall structural integrity of the receiver due to the fact the force of the bolt mechanism during firing of the firearm is distributed between the receiver housing and the receiver cover.

BACKGROUND

Portable firearms such as, for example, semiautomatic rifles (e.g., a Marlin Model 60) require disassembling to remove the bolt mechanism. To remove a bolt mechanism with its recoil spring assembly and the charging handle from a firearm such as, for example, an original Ruger®10/22®, it is necessary to remove the receiver from the stock and remove the trigger group. Subsequently, the charging handle should be pushed backwards to remove the bolt mechanism in a downwardly direction.

Moreover, to clean the barrel and the bolt mechanism, tools are necessary to remove mechanically fasteners, such as, for example, screws and pins.

Yet further, some receiver structural designs include a removable cover that lacks secure means of securely maintaining the receiver cover on the receiver housing during firing of the firearm. Such removable covers may not enhance the overall structural integrity of the receiver during the firing of the firearm. For instance, during the firing of the firearm, the bolt mechanism travels backwardly and impacts the aft/rear of the receiver may). Over time, the overall operating life of the receiver becomes compromised due to impacts from the bolt mechanism.

SUMMARY

Embodiments relate to a receiver for a firearm or pistol that facilitates the expedient and efficient removal of the bolt mechanism from a top region of the receiver without the necessity for tools and/or removal of the entire receiver from the stock of the firearm.

The receiver in accordance with embodiments has a design that also facilitates the expedient and efficient cleaning of the bolt mechanism and the barrel.

The receiver in accordance with embodiments has a design that also does not require diminishing the overall structural integrity of the receiver.

The receiver in accordance with embodiments has a design that includes structural dimensions that conforms or otherwise correspond to the original measurements of the corresponding firearm, and particularly, a Ruger® 10/22®. Accordingly, the receiver design is structurally compatible with original Ruger® 10/22 ® components. Embodiments of the structural design, however, are not limited for application to only the Ruger® 10/22®, and thus, may also have application for other semiautomatic firearms and/or rifles.

The receiver in accordance with embodiments includes a receiver housing defining an internal region therein to receive components, such as, for example, a bolt mechanism of the firearm. A receiver cover is removeably positioned on the receiver housing. A guide assembly facilitates movement of the receiver cover relative to the receiver housing between an operating position to cover the internal region, and a non-operating position to at least partially expose the internal region. The exposure of the internal region facilitates access to components of the firearm (e.g., the bolt mechanism) for cleaning. This also advantageously facilitates such access and cleaning without the necessity to disassemble the entire receiver.

The receiver in accordance with embodiments includes two separately spaced locking assemblies that rigidly connect the receiver housing and the receiver cover. A first locking assembly is to removeably lock the receiver housing and the receiver cover at a front/forward region of the receiver, while a second locking assembly is to removeably lock the receiver housing and the receiver cover at an aft/rear region of the receiver. Such a design ensures that the receiver cover is securely maintained on the receiver housing during the firing of the firearm. The first and second locking assemblies further ensures the overall structural integrity of the receiver during the firing of the firearm by allowing the receiver cover to absorb some of the force of the bolt mechanism during firing of the firearm without becoming dislodged from the receiver housing. This enhances the overall operating life of the receiver due to alleviating the force of impact by distributing the force between the receiver housing and the receiver cover.

DRAWINGS

Figure 12:
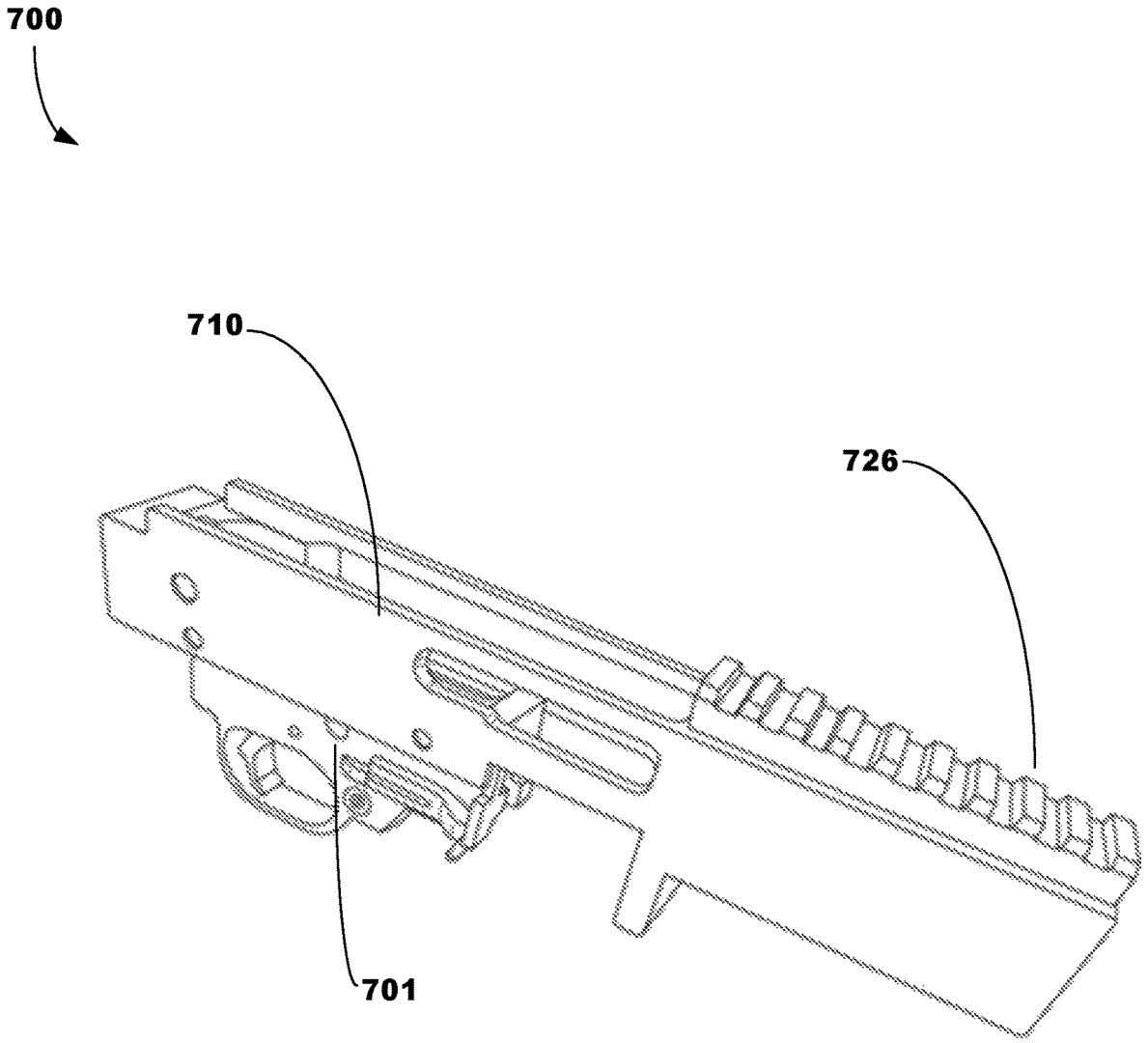
Figure 13:
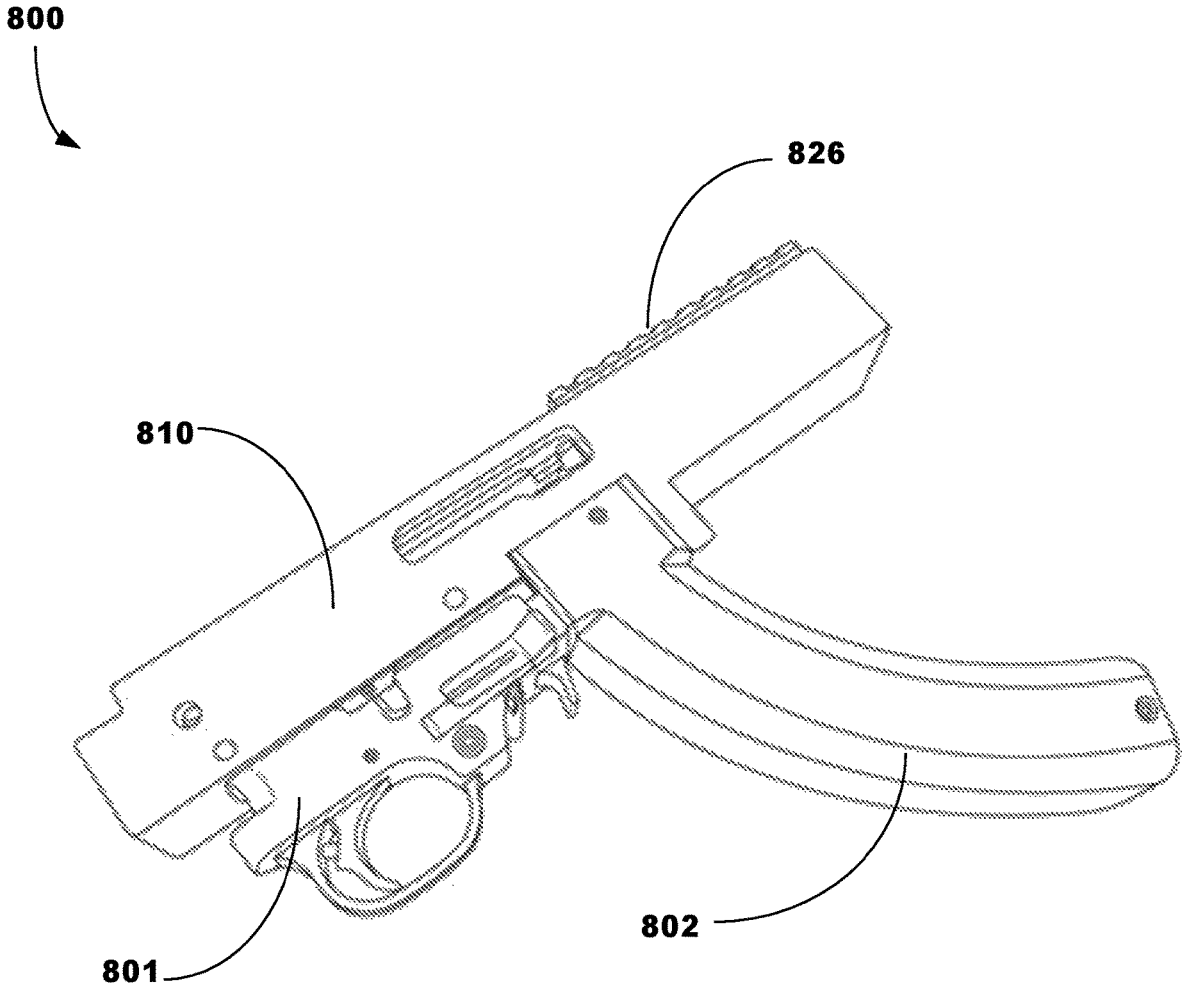

FIGS. 12 and 13 respectively illustrate a perspective view of a firearm having a receiver with a picatinny rail arranged at a top surface thereof, in accordance with embodiments.

Figure 14:
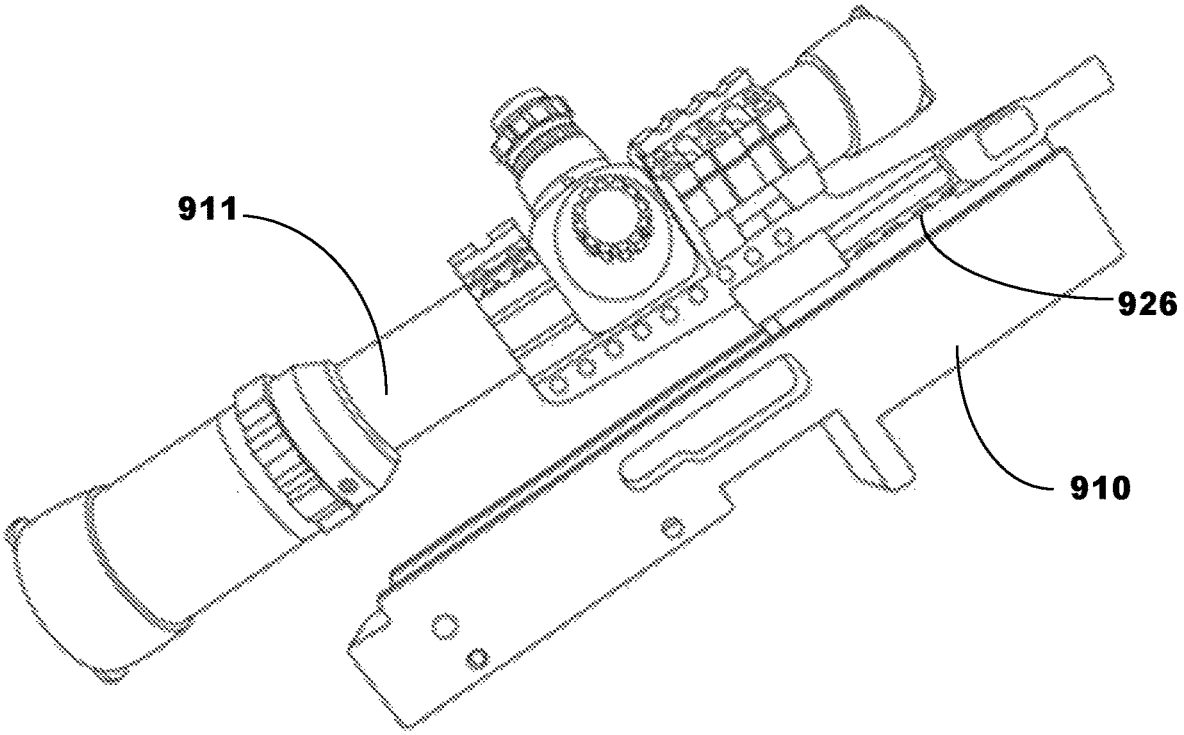

FIG. 14 illustrates a perspective view of a rife or firearm scope mounted on a picatinny rail of a receiver, in accordance with embodiments.

DESCRIPTION

In accordance with embodiments, FIGS. 4 to 10 illustrate the same embodiment of the invention. This embodiment might comprise, for example, the technical details illustrated in FIGS. 1 to 3.

Figure 1:
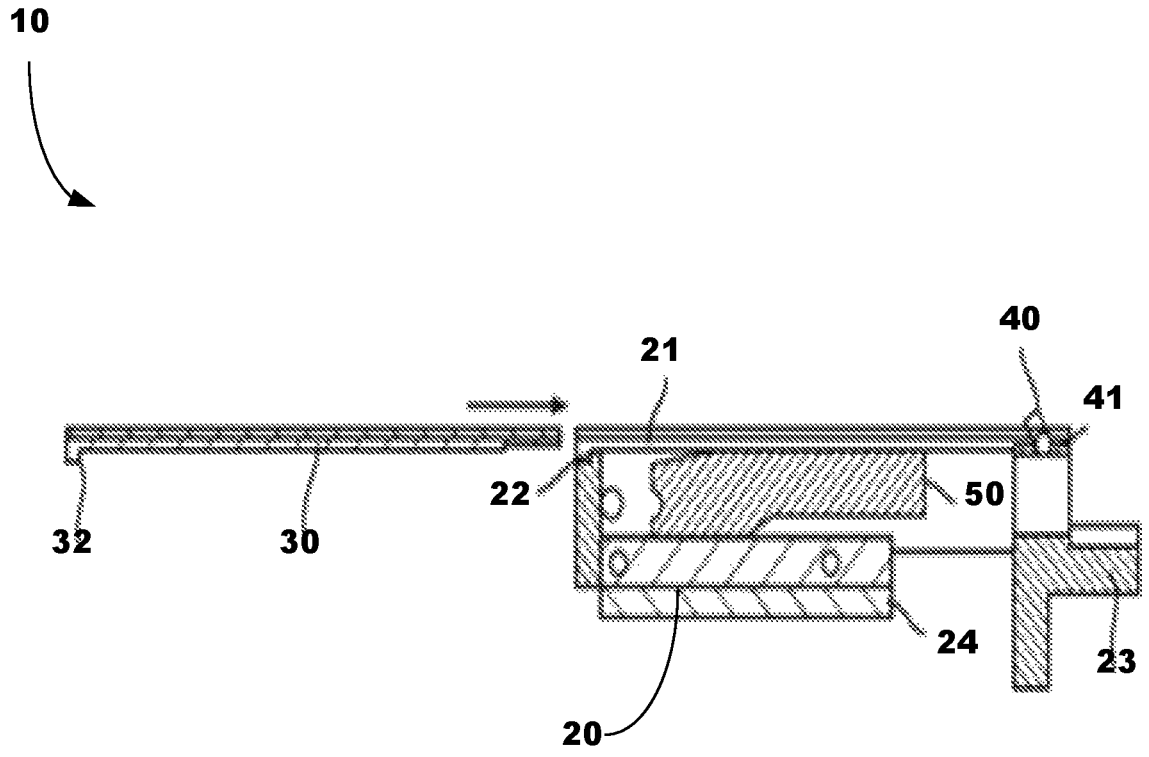
FIG. 1 illustrates a cross-sectional view of a receiver, in accordance with embodiments, with a receiver cover in a removed position.
Figure 2:
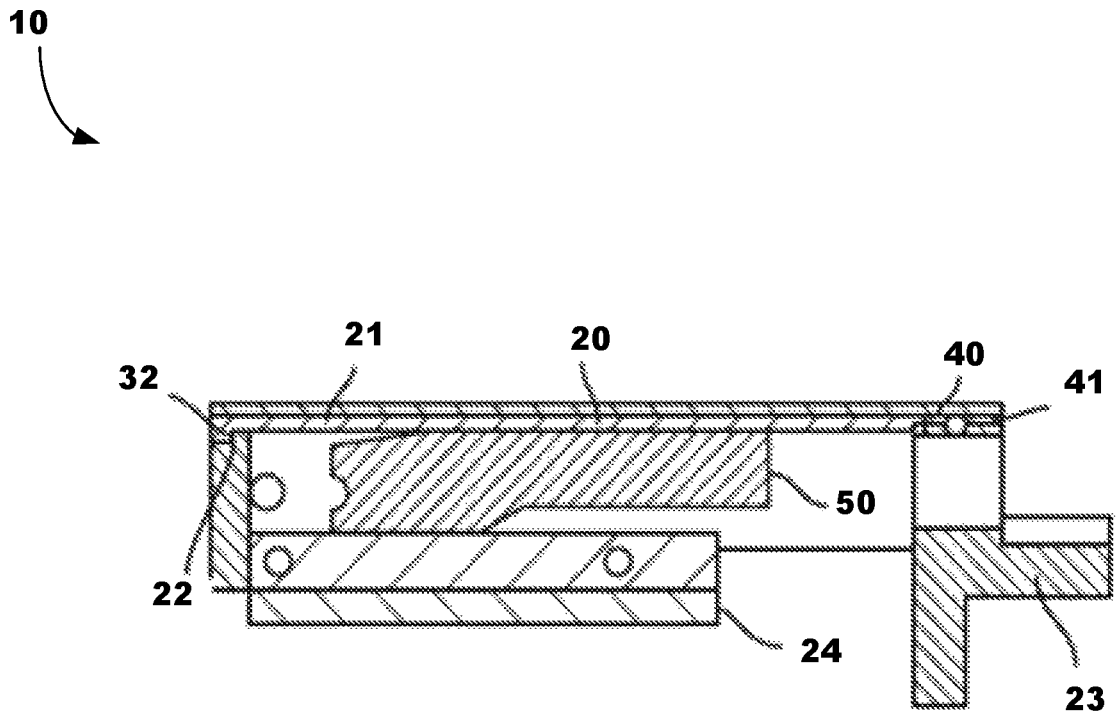
FIG. 2 illustrates a cross-sectional view of the receiver of FIG. 1, with the receiver cover in a closed position.

As illustrated in FIGS. 1 and 2, a receiver 10 in accordance with embodiments may comprise a receiver housing 20, a receiver cover 30 to cover the receiver housing 20, a guide assembly to facilitate movement of the receiver cover 30 relative to the receiver housing 20, and locking assembly to removeably lock the receiver cover 30 to the receiver housing 20 at front and rear regions of the receiver 10. In all embodiments, the components of the receiver 10 may have a material composition that facilitates practice of the embodiments disclosed herein. Such materials, for example, may comprise metals, polymers, composites, and/or combinations thereof. The receiver cover 30 may be composed of the same material as the receiver housing 20. Alternatively, the receiver cover 30 may be composed of a material having a higher strength than the receiver housing 20. Further, the thickness of the receiver cover 30 may be the same as the wall thickness of the receiver housing 20.

The receiver housing 10 has an internal region 25 which is to receive components, such as for example, a bolt mechanism 50 of the firearm. The receiver housing 20 may be connected to the firearm and/or rifle at a distal end 23 of the receiver housing using one or more mechanical fasters (e.g., screws).

The receiver cover 30 is removeably positioned on the receiver housing 20 for movement between an operating position (FIG. 2) to cover the internal region 25 (in which the locking assembly is engaged and placed in a locked position), and a non-operating position (FIG. 1) to expose the internal region 25 (in which the locking assembly is engaged and placed in an unlocked position). The exposure of the internal region 25 facilitates access to components, such as, for example, the bolt mechanism 50 of the firearm. This advantageously facilitates access and cleaning without the necessity to disassemble the entire receiver 10 from the firearm. The receiver cover 30 (and all embodiments thereof) may have a substantially planar uppermost surface such that, in the fully closed position, the uppermost surface may planar such that it is to lie substantially coplanar with the uppermost surface of the receiver housing 20. Embodiments, however, are not limited to such a configuration, and thus, the uppermost surface of the receiver cover 30 may have a non-planar configuration and/or one that includes a picatinny rail thereon, or with threads to mount a separate picatinny rail.

As illustrated in FIG. 3A and FIGS. 7 through 10, in accordance with embodiments, the receiver cover 30 may have a general configuration of a rectangular in longitudinal cross-section. Embodiments, however, are not limited to such a configuration, and thus, the receiver cover 30 may have any geometric configuration that permits practice of embodiments.

The guide assembly comprises rails 31 on the receiver cover 30 and grooves or notches 21 arranged at an upper region of the receiver housing 20 which are to receive the rails 30 upon insertion of the rails 31 therein. The rails 31 may project laterally outward from the base of the receiver cover 30 while also extending longitudinally throughout the length of the base of the receiver cover 30. The grooves or notches 21 extend longitudinally throughout the length of the receiver housing 20 in such a way that facilitates support and linear movement of the receiver cover 30 relative to the receiver housing 20 along the longitudinal axis of the receiver housing 20. Particularly, such linear movement of the receiver cover 30 may follow in the direction of the notches 21. Embodiments, however, are not limited to such a configuration, and thus, may have a configuration in which the receiver housing 20 has rails while the receiver cover 30 has grooves.

A first locking assembly is to facilitate a first connection of the receiver housing 20 and the receiver cover 30 at a first connection region of the receiver 10. The first locking assembly may comprise a locking lever 40 and a locking pin 41 operatively connected to the locking lever 40. The locking pin 41 is to extend laterally, i.e., perpendicularly to the longitudinal axis of the receiver housing 20, across the inner width of the receiver housing 20. The locking pin 41 may structurally conform with a semicircular indent 33 at the bottom surface of the receiver cover 30. The locking lever 40 is rotatable about a rotational axis defined by the locking pin 41. In accordance with embodiments, the locking assembly may be spring loaded, and incorporate a variety of pin types and levers.

The locking pin 41 is to engage the receiver cover 30 when the first locking assembly is in a locked state. The locking pin 41 is to disengage the receiver cover 30 when the locking assembly is in an unlocked state. The locking pin 41 may be grinded/milled to the half of its diameter in the middle at the length of the receiver cover 30, to allow the receiver cover 30 to slip over it, in the opened position. The locking lever 40 is to act as a flat spring, and may clip into a recess of the receiver housing 20, such that the first locking assembly cannot unlock without engaging the locking lever 40. Although removal of the first locking assembly for disassembly is not necessary in the illustrated embodiments, it may be configured to be removeable for disassembly, like pins or screws.

A second locking assembly is to facilitate a second connection of the receiver housing 20 and the receiver cover 30 at a second connection region of the receiver 10. The second locking assembly may comprise an end stop 22 projecting upwardly from the receiver housing 20 and a corresponding end stop 32 arranged at a distal longitudinal end of the receiver cover 30. The end stop 32 is to project perpendicularly relative to the longitudinal axis of cover 30. The end stop 32 may comprise a bar or a protrusion that is to physically abut, i.e., contact, the end stop 22 when the receiver cover 30 is placed in a fully closed position on the receiver housing 20.

In practice, the second locking assembly is locked by moving, via the guide assembly, the receiver cover 30 in a forwardly direction towards the receiver housing 20 until an end of the receiver cover 30 is operatively connected or otherwise contacts the receiver housing 20. The end stop 32 is to thereby come into direct contact with the corresponding end stop 22 of the receiver housing 20. Due to insertion of the rails 31 into the notches 21, engagement of the corresponding end stops 22, 32 serves to prevent further linear movement of the receiver cover 30 along the guide assembly in a direction (e.g., longitudinally) towards the receiver housing 20. The guide assembly, via receipt of the rails 31 into the notches 21, also serves to prevent movement of the receiver cover 30 relative to the receiver housing 20 in a vertical direction (i.e., in a plane that is perpendicular to the horizontal plane of the receiver cover 30). This arrangement makes it possible to move the receiver cover 30 only horizontally to a final operating position on the receiver housing 20.

Upon engagement of the end stops 22, 32, the first locking assembly may then be placed in a locked state by moving the locking lever 40 in a clockwise direction, thereby rotating the locking pin 41 to engage the bottom surface of the receiver cover 30. Such a multi-lock arrangement thereby facilitates locking the receiver cover 30 on the receiver housing 20 at two separate regions of the receiver 10, namely, the rear and forward regions of the receiver 10. The multi-lock arrangement ensures that the receiver cover 30 is securely maintained on the receiver housing 20 during the firing of the firearm. The multi-lock arrangement also enhances the overall structural integrity of the receiver during the firing of the firearm by allowing the receiver cover 30 to absorb (at least partially) some of the force of the bolt mechanism 50 during firing of the firearm. This advantageously enhances the overall operating life of the receiver 10 by distributing the force of the bolt mechanism 50 between the receiver cover 10 and the receiver housing 20.

In order to remove the receiver cover 30 from the receiver housing 20, the first locking assembly is placed in an unlocked state by moving the locking lever 40 in a counterclockwise direction. This will thereby permit reverse movement of the receiver cover 30 along the guide assembly in a direction (e.g., longitudinally) away from the receiver housing 20.

Figure 3A:
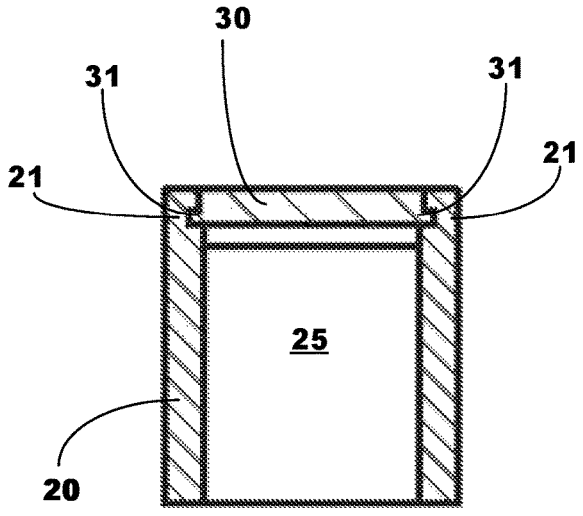
FIGS. 3A to 3D illustrates front cross-sectional views of different embodiments of notches and rails of a receiver.
Figure 3B:
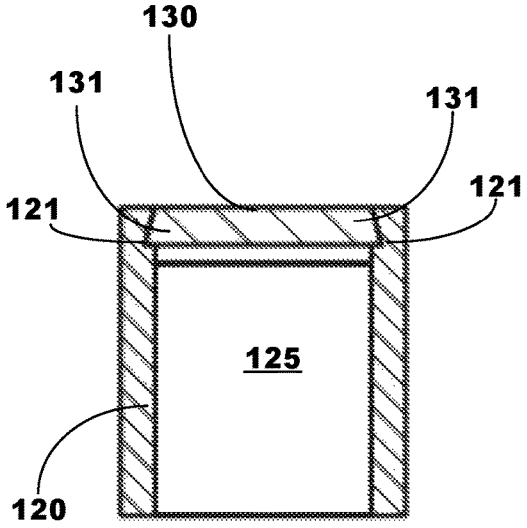

As illustrated in FIG. 3B, in accordance with embodiments, alternatively, the receiver cover 130 may have a general configuration of an isosceles trapezoid in longitudinal cross-section. The connection portion of the receiver cover 130 has outer base points 131 that are arranged such that, when the receiver cover 130 is mounted on the receiver housing 120, are to rest on stepped-portions 121 arranged at an upper region of the receiver housing 120. This permits support and movement of the receiver cover 130 relative to the receiver housing 220 along the longitudinal axis of the receiver housing 220. The stepped-portions 121 may extend longitudinally throughout the length of the receiver housing 20. Such an embodiment also includes an end stop (not illustrated) for the receiver cover 130 and a corresponding end stop (not illustrated) of the receiver housing 120.

Figure 3C:
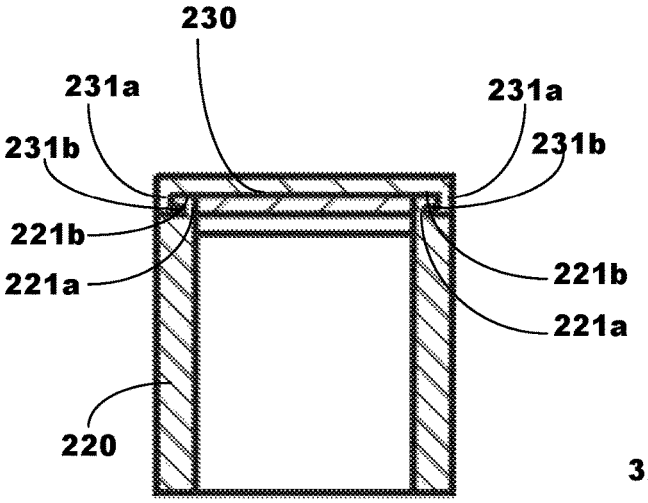

As illustrated in FIG. 3C, in accordance with embodiments, alternatively, the receiver cover 230 may comprise cover connection members 231 having an L-shape in longitudinal cross-section. Particularly, each cover connection member 231 comprises a downwardly-projecting (i.e., extending substantially perpendicular relative to the base of the receiver cover 230) first cover arm 231*a* and a second cover arm 231*b* that extends inwardly from the first cover arm 231*a* to project substantially perpendicular relative to the first cover arm 231*a*. The first cover arm 231*a* and the second cover arm 231*b* may extend longitudinally throughout the length of the base of the receiver cover 230.

The receiver housing 220 comprises receiver housing connection members 221 having an L-shape in longitudinal cross-section that correspond to the receiver cover connection members 231 of the receiver cover 230 in such a manner that permits support and movement of the receiver cover 230 along the longitudinal axis of the receiver housing 220. Particularly, each receiver housing connection member 231 comprises an upwardly-projecting (i.e., extending substantially parallel relative to the first cover arm 231*a*) first receiver housing arm 221*a* and a second receiver housing arm 221*b* that extends outwardly from the first receiver housing arm 221*a* to project substantially perpendicular relative to the first receiver housing arm 221*a*. The first receiver housing arm 221*a* and the second receiver housing arm 221*b* may extend longitudinally throughout the length of the base of the receiver housing 220. Such an embodiment also includes an end stop (not illustrated) for the receiver cover 230 and a corresponding end stop (not illustrated) of the receiver housing 220.

Figure 3D:
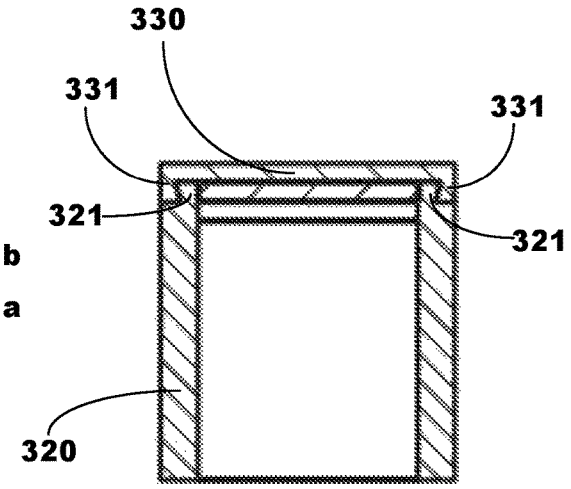

As illustrated in FIG. 3D, in accordance with embodiments, alternatively, the receiver cover 330 may comprise cover connection member that includes a downwardly-projecting (i.e., extending substantially perpendicular relative to the base of the receiver cover 330) cover arm 331. The receiver cover arm 331 may extend longitudinally throughout the length of the base of the receiver cover 330.

The receiver housing 320 comprises a receiver housing connection member that includes an upwardly-projecting (i.e., extending substantially parallel relative to the receiver cover arm 331) receiver housing arm 321 that corresponds to the receiver cover arm 331 in such a manner that permits support and movement of the receiver cover 330 along the longitudinal axis of the receiver housing 320. Such an embodiment also includes an end stop (not illustrated) for the receiver cover 330 and a corresponding end stop (not illustrated) of the receiver housing 320.

FIGS. 4-7 illustrate examples of the different stages states of engaging and disengaging the first locking assembly, in accordance with embodiments.

Figure 4:
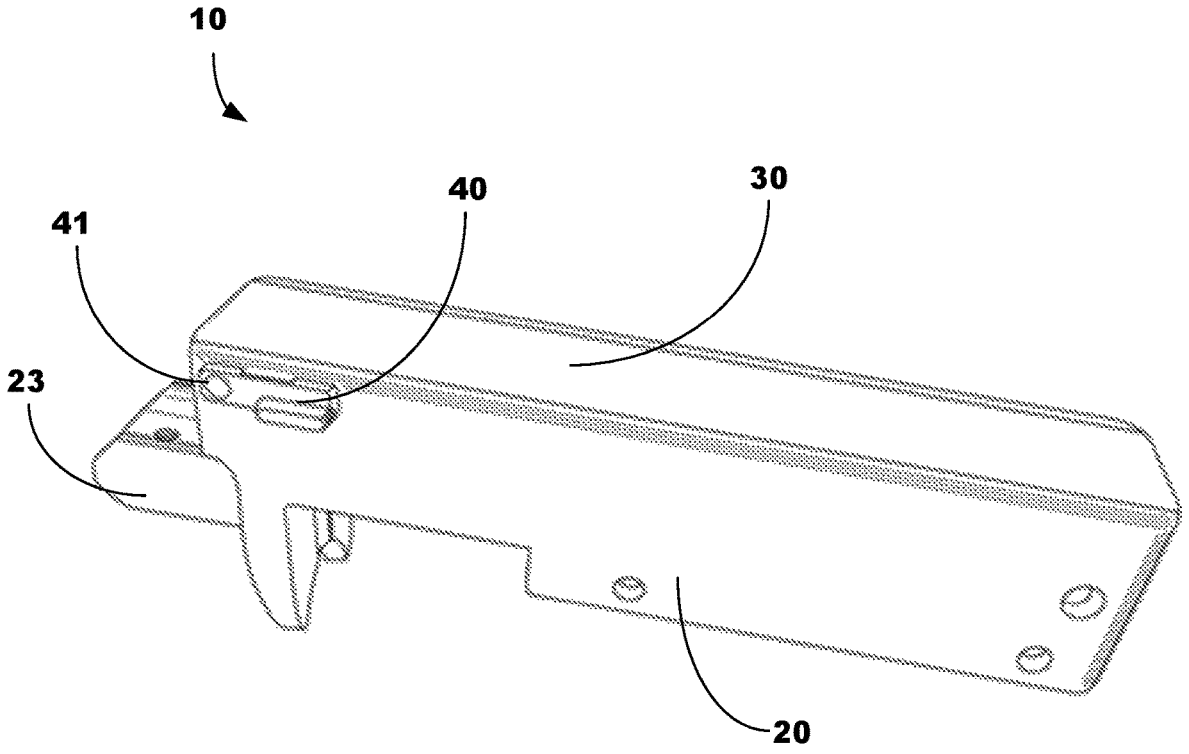
FIG. 4 illustrates a perspective view of the receiver of FIG. 1, with the receiver cover in a closed position and the locking lever in a locked position.

As illustrated in FIG. 4, the receiver 10 is in a fully operable state. In operation, after the receiver cover 30 is moved forwardly towards the receiver housing 20, the locking lever 40 is rotated in a clockwise direction, which in turn, facilitates a corresponding clockwise movement of the locking pin 41 to lock the receiver cover 30 into position on the receiver housing 20. When placed in the locked position, the first and second locking assemblies are to prevent movement of the receiver cover 20 along the guide assembly in a direction (e.g., longitudinally) away from the receiver housing 20. The receiver cover 30 and the receiver housing 20 also form a complete and rigid receiver 10, in which the receiver housing 20 and the receiver cover 30 are in a fixed connection with each other.

Figure 5:
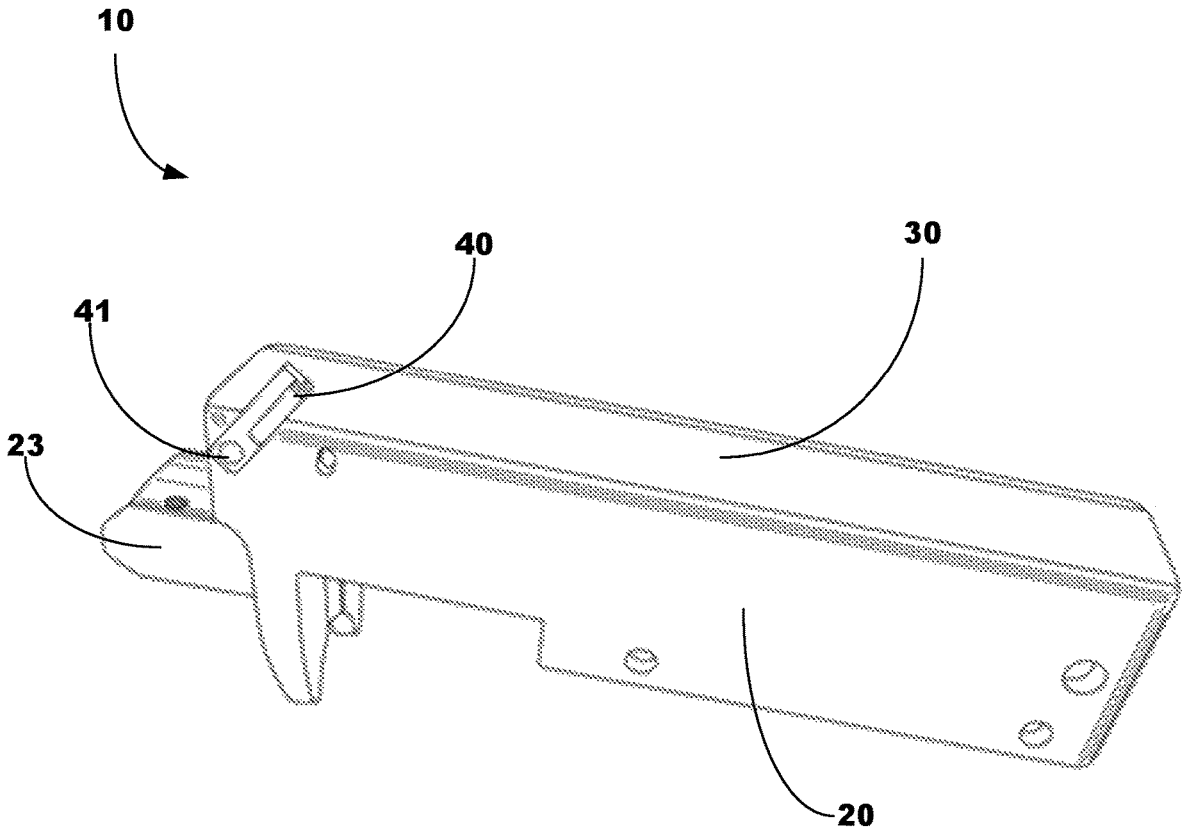
FIG. 5 illustrates a perspective view of the receiver of FIG. 1, with the receiver cover in a closed position and the locking lever in an unlocked position.

As illustrated in FIG. 5, disengaging the locking assembly results from a counterclockwise movement of the locking lever 40, which in turn, facilitates a corresponding counterclockwise movement of the locking pin 41 to unlock the receiver cover 30 from its position on the receiver housing 20.

Figure 6:
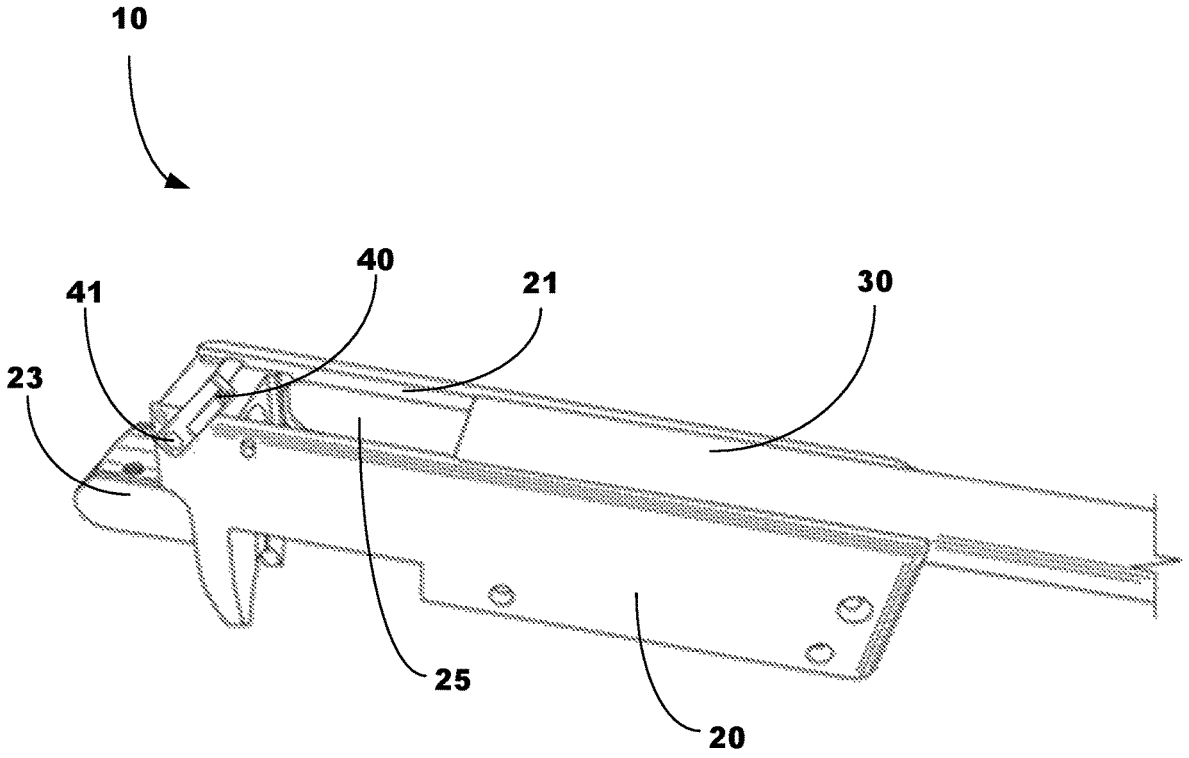
FIG. 6 illustrates a perspective view of the receiver of FIG. 1, with the receiver cover in a partially-open position and the locking lever in an unlocked position.

As illustrated in FIG. 6, the unlocking of the locking assembly facilitates linear movement of the receiver cover 30 along the notches 21 of the receiver housing 20 in a direction along the longitudinal axis of the receiver housing 20. Such a movement also serves to disengage the end stops 22, 32 from each other.

Figure 7:
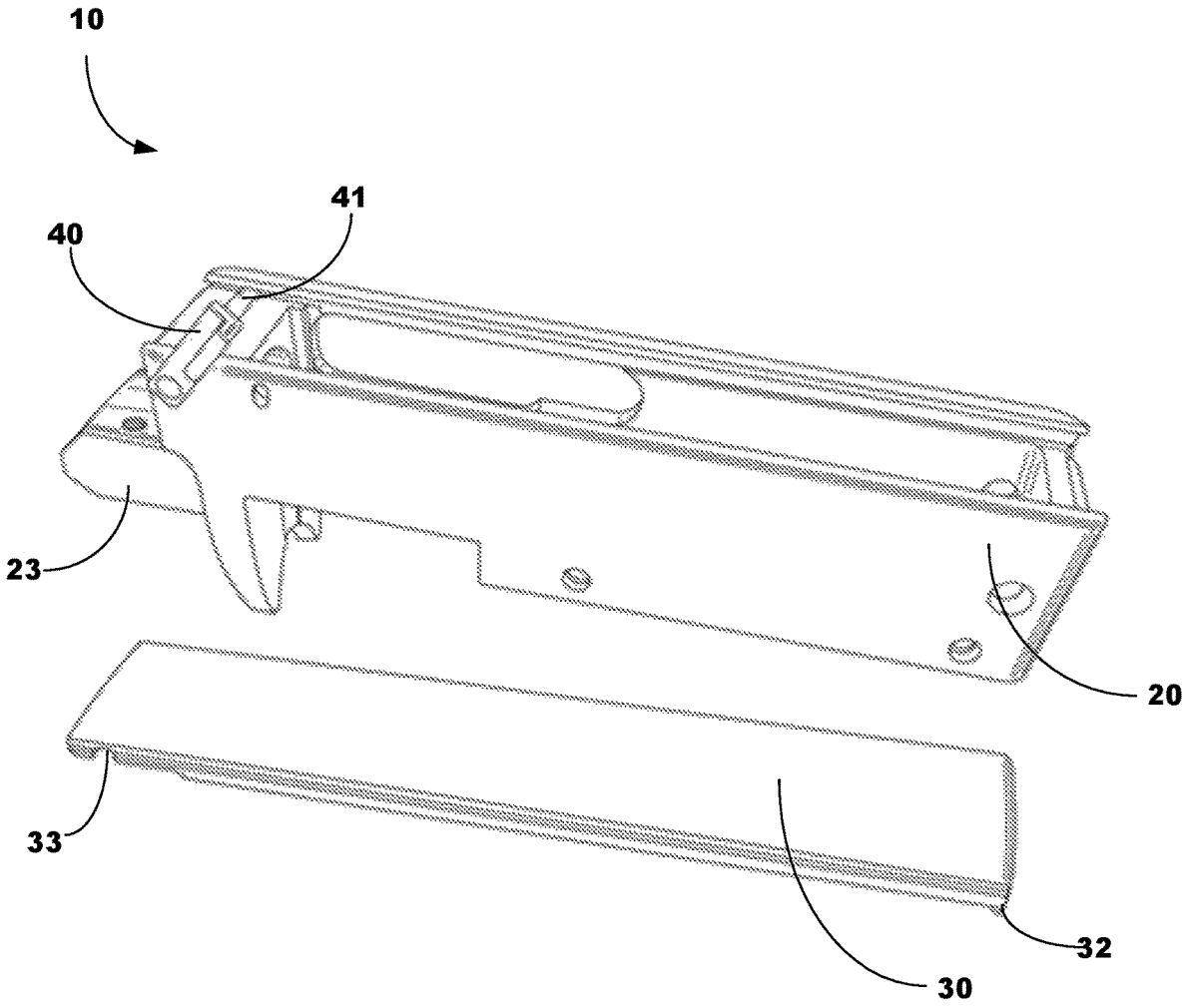
FIG. 7 illustrates a perspective view of the receiver of FIG. 1, with the receiver cover removed from the receiver housing.

As illustrated in FIG. 7, the receiver cover 30 may be completely removed from the receiver housing 20. Advantageously, for example, the bolt mechanism 50 may be removed/inserted with its recoil spring assembly and the charging handle, without need to disassemble or remove the entire receiver from the firearm. Moreover, such a procedure also may be performed manually without use of any mechanical tools. It is also possible to clean the barrel of the firearm without removing it, through the more flat angle of the cleaning rod.

In accordance with embodiments, the two-piece design of the receiver 10 that includes the guide assembly and locking assemblies ensures that both the receiver housing 20 and the receiver cover 30 encompass the carrying structure, which makes the receiver 10 more structurally robust. This enhances the structural integrity of the receiver 20 during firing of the firearm.

Alternatively, embodiments may include a receiver cover having a structure that facilitates insertion from the front. If there are recesses in the rails and the notches, it is also possible to insert the receiver cover from above, and push it forward or back to a final operating position.

Figure 8A:
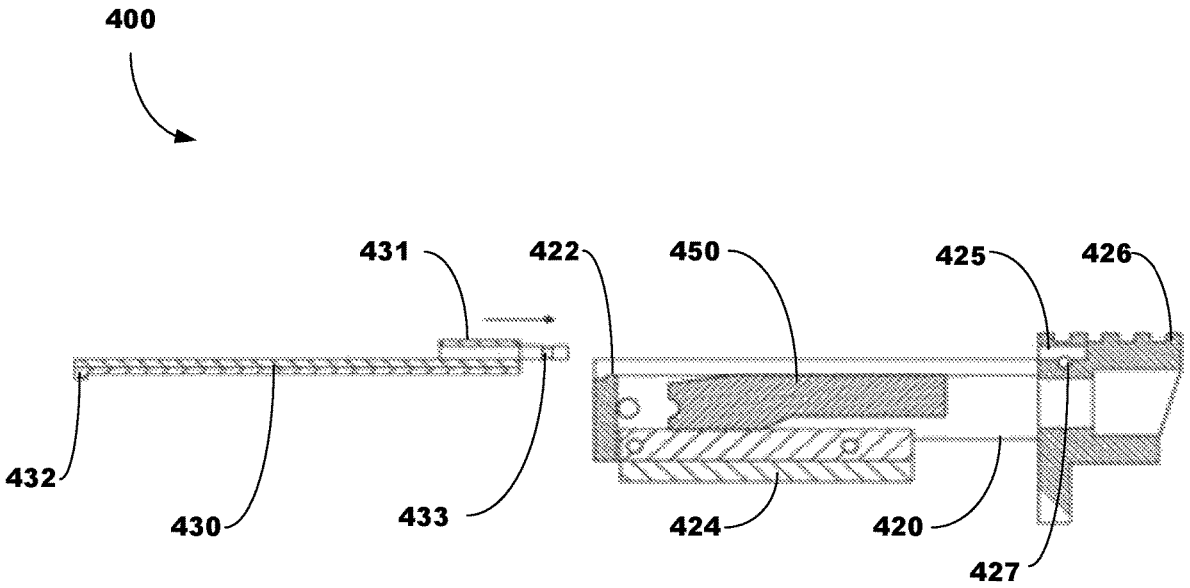
FIGS. 8A and 8B illustrate a cross-sectional view of a receiver in accordance with embodiments, with a receiver cover in a removed position, and a side view of a mechanical fastener for the receiver of FIG. 8A.
Figure 8B:
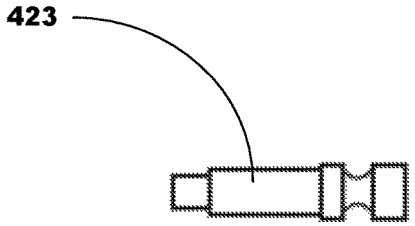

As illustrated in FIGS. 8A and 8B, in accordance with embodiments, alternatively, the receiver 400 may comprise a receiver cover 430 including a receiver recess 431 that extends in a direction of (i.e., parallel to) the longitudinal axis of the receiver cover 430. The receiver recess 431 may include, for example, a plurality of internal threads to receive corresponding external threads of a mechanical fastener, such as, for example, a first locking bolt or screw 433. Embodiments, however, may include other threaded or even unthreaded configurations.

The first locking screw 433 is to extend from the receiver cover 430 in a direction of the longitudinal axis of the receiver cover 430 once received into the receiver access 431. Such extension of the first locking screw 433 facilitates receipt of a distal end thereof into a corresponding first receiver housing recess 425 of the receiver housing 420 when the receiver cover 430 is mounted on the receiver housing 420. Embodiments are not limited to such a locking arrangement, and may encompass, for example, a first locking assembly in which the external threads of the first locking screw 433 correspond to internal threads in the first receiver housing recess 425.

In accordance with embodiments, the first receiver housing recess 425 extends in a direction of (i.e., parallel to) the longitudinal axis of the receiver housing 420. A second receiver housing recess 427 extends in a direction perpendicular to the longitudinal axis of the receiver housing 420 and is to receive a second locking screw 423, which is to thereby facilitate locking the receiver cover 430 into position when mounted on the receiver housing 420.

In accordance with embodiments, the first locking screw 433 may be selectively moveably attached to the receiver cover 430 in a manner that facilitates the selective adjustment of the locking position of the receiver cover 430 on the receiver housing 420.

In operation, the linear movement of the receiver cover 430 along the guide assembly in a direction along the longitudinal axis of the receiver housing 420 facilitates receipt of the first locking assembly into the receiver housing recess 425, thereby providing a first connection between the receiver housing 420 and the receiver cover 430 at a first locking region. As in previous embodiments, the second locking assembly is locked via engagement of the corresponding end stops 422, 432 to provide a second connection between the receiver housing 420 and the receiver cover 430 at a second locking region.

The selective adjustment of the first locking assembly is caused by the selective adjustment of the first locking screw 433 relative to the receiver cover 430 and/or the first receiver housing recess 425. This advantageously compensates or otherwise overcomes manufacturing tolerances between the receiver housing 420 and the receiver cover 430.

In the illustrated embodiment, the receiver 400 has a picatinny rail 426 arranged on the receiver housing 420 to facilitate placement of auxiliary components (See, FIG. 14) of the rifle or firearm thereon. The picatinny rail 426 includes a plurality of spaced ridges defining grooves that form a platform in which to mount the auxiliary components. In the illustrated example, the picatinny rail 426 may be mounted or otherwise positioned for placement at an uppermost surface at the top of the receiver housing 420. Embodiments, however, are not limited to such a configuration, and thus, the picatinny rail 426 may be spatially arranged, for example, on a side surface of the receiver housing 420, or alternatively, on an uppermost surface at the top of the receiver cover 430. The picatinny rail 426 may be integrated into the structure of the receiver housing 420 or receiver cover 430, or alternatively, be mounted (fixed or removeably) on a surface of the receiver housing 420 or receiver cover 430.

Figure 9A:
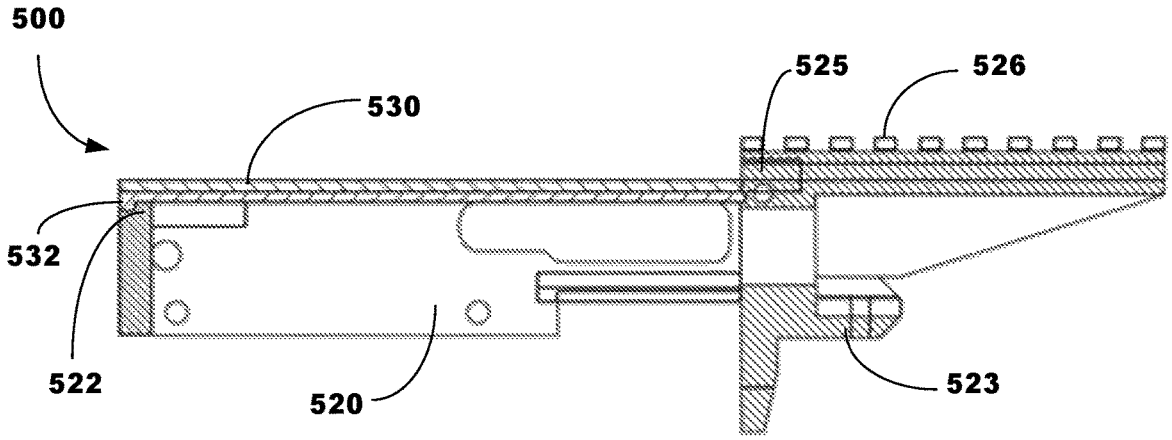
FIGS. 9A to 9C illustrates side, front, and top views of a receiver, in accordance with embodiments.
Figure 9B:
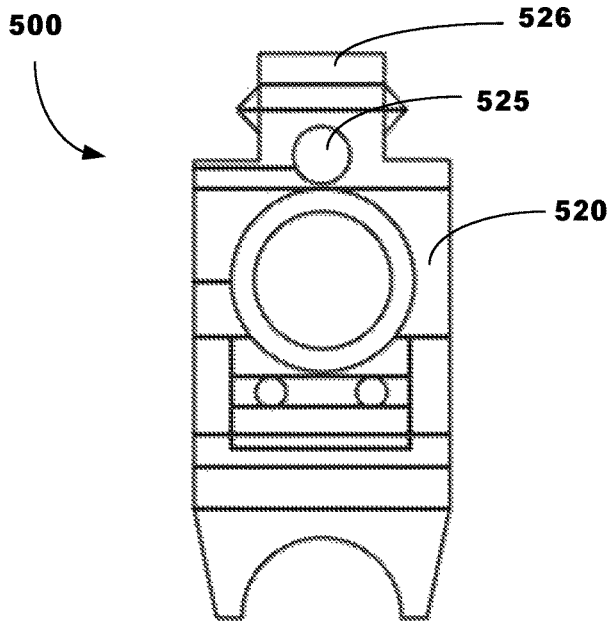
Figure 9C:
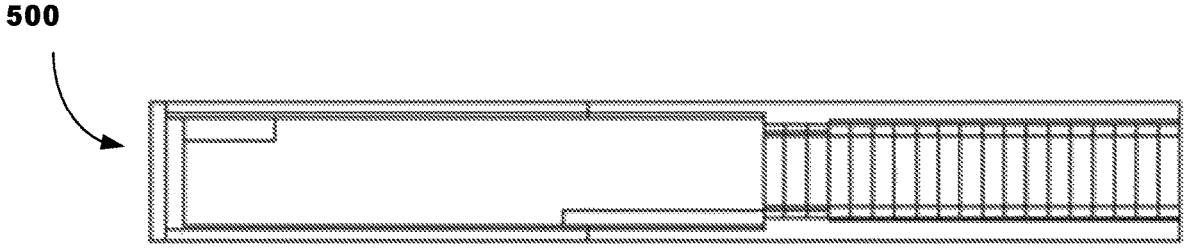
Figure 10A:
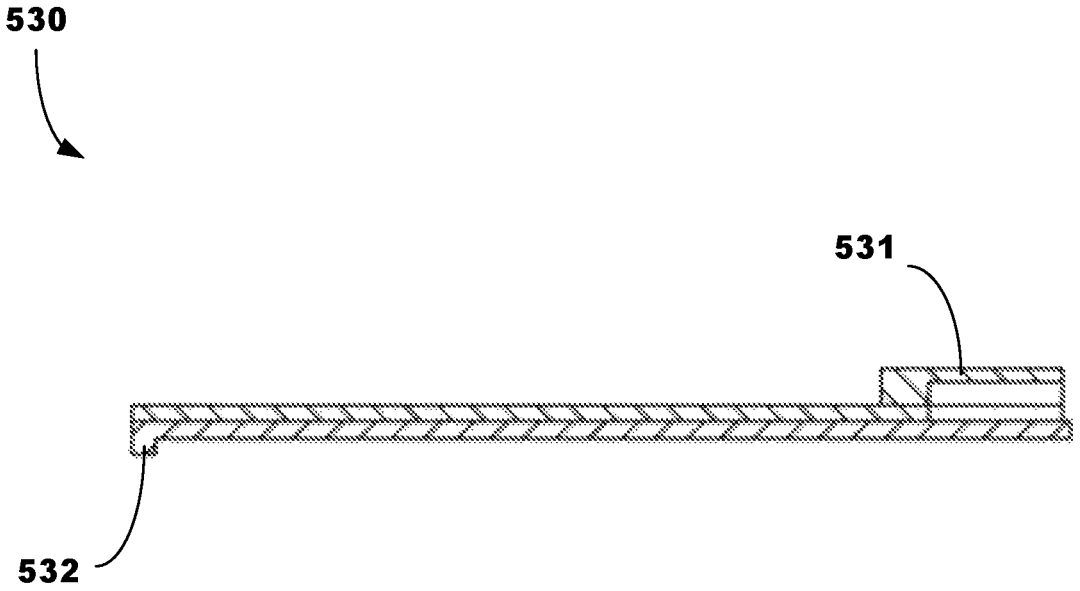
FIGS. 10A and 10B illustrate a cross-sectional view of a cover, and a side view of a mechanical fastener for the receiver of FIGS. 9A to 9C.
Figure 10B:
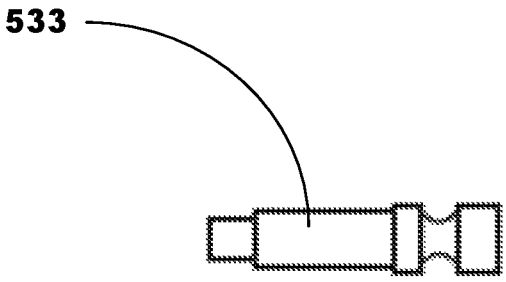

FIGS. 9 and 10 illustrate another embodiment of a receiver 500 having a receiver housing 520 with a picatinny rail 526 arranged thereon. In the illustrated examples, the picatinny rail 526 is mounted or otherwise positioned for placement at an uppermost surface at the top of the receiver housing 520. Embodiments, however, are not limited to such a configuration, and thus, the picatinny rail 526 may be spatially arranged, for example, on a side surface of the receiver housing 520, or alternatively, on an uppermost surface at the top of the receiver cover 530.

As illustrated in other embodiments, a first locking screw 533 may be moveably received by the receiver access 531 of the receiver cover 530 in a manner that facilitates the selective adjustment in the locking position of the receiver cover 530 on the receiver housing 520. Embodiments are not limited to such a locking arrangement, and may encompass, for example, a locking arrangement in which the external threads of the locking screw 533 correspond to internal threads in the first receiver housing recess 525.

In accordance with embodiments, alternatively or additionally, the receiver cover 530 may be locked into position via a mechanical locking pin (not illustrated) that is to be removeably received by a corresponding second receiver housing recess that extends in a direction perpendicular to the longitudinal axis of the receiver housing 520.

Figure 11:
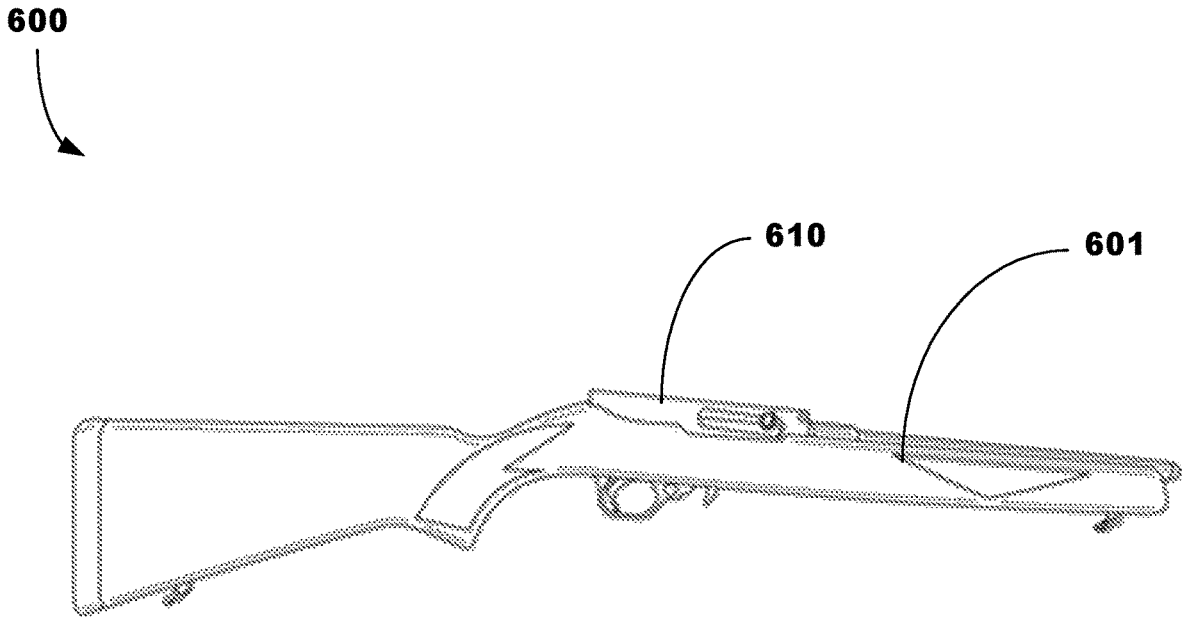
FIG. 11 illustrates a side view of a rifle having a receiver, in accordance with embodiments.

FIG. 11 illustrates a portable firearm 600 comprising a rifle 601 and a receiver 610 mounted on the rifle 601. The receiver 610 may comprise any of the embodiments described herein.

FIG. 12 illustrates a portable firearm 700 comprising a hand-held gun 701 (semi-automatic or automatic) and a receiver 710 mounted on the hand-held gun 701. The receiver 710 may comprise any of the embodiments described herein. In the illustrated embodiment, the receiver 710 includes a picatinny rail 726.

FIG. 13 illustrates a portable firearm 800 comprising a hand-held gun 801 (semi-automatic or automatic) having a "banana-shaped" box magazine 802, and a receiver 810 mounted on the hand-held gun 801. The receiver 810 may comprise any of the embodiments described herein. In the illustrated embodiment, the receiver 810 includes a picatinny rail 826.

FIG. 14 illustrates a receiver 910 for connection to a firearm, and which includes a picatinny rail 926 upon which is mounted a scope 911. The receiver 810 may comprise any of the embodiments described herein.

In accordance with embodiments, the trigger group may be installed using two mechanical fasteners such as, for example, pins. It is also possible, however, to produce embodiments using screws or alternative locking mechanisms. The barrel may be held in place with the original barrel retainer, which is screwed at a distal end of the receiver housing. It is also possible to produce a receiver having all sorts of takedown systems to mount the barrel. The barrel may be also mechanically screwed into the receiver, pressed in, or fixed using pins, depending on what is necessary for different rifles or firearms. The removable cover will not restrict the variations of installing barrels or trigger groups.

ADDITIONAL NOTES AND EXAMPLES

Example One may include a receiver for a firearm, the receiver comprising: a receiver housing defining an internal region; a receiver cover to be mounted on the receiver housing; a guide assembly that permits movement of the receiver cover relative to the receiver housing between an operating position to cover the internal region, and a non-operating position to at least partially expose the internal region and thereby facilitate access to the internal region; a first locking assembly to facilitate, when the receiver cover is mounted on the receiver housing, a first connection of the receiver housing and the receiver cover at a first region of the receiver; and a second locking assembly to facilitate, when the receiver cover is mounted on the receiver housing, a second connection of the receiver housing and the receiver cover at a second region of the receiver.

Example Two may include the receiver of Example One, a first receiver housing recess to extend in a direction of a longitudinal axis of the receiver housing; a second receiver housing recess to extend in a direction perpendicular to the longitudinal axis of the receiver housing; a first locking fastener to extend from the receiver cover for receipt into the first receiver housing recess when the receiver cover is mounted in the operating position on the receiver housing; and a second locking fastener for receipt into the second receiver housing recess when the receiver cover is mounted in the operating position on the receiver housing.

Example Three may include the receiver of Example Two, wherein the first locking fastener is selectively adjustably moveable relative to the receiver cover to thereby adjust the position of the receiver cover relative to the receiver housing.

Example Four may include the receiver of Example One, wherein the second locking assembly comprises: a receiver housing stop arranged at a distal end of the receiver housing; and a receiver cover stop arranged at a distal end of the receiver cover, and which is to engage the receiver housing stop to thereby facilitate the first connection.

Example Five may include the receiver of Example One, wherein the guide assembly comprises: grooves arranged at an upper region of the receiver housing; and rails on both sides of the receiver cover, and which are to be received into the grooves to facilitate movement of the receiver cover relative to the receiver housing in a direction parallel to the longitudinal axis of the receiver cover.

Example Six may include the receiver of Example Five, wherein receipt of the rails into the grooves are to prevent movement of the receiver cover relative to the receiver housing in a direction perpendicular to the longitudinal axis of the receiver cover.

Example Seven may include the receiver of Example One, wherein the receiver housing or the receiver cover comprises a picatinny rail.

Example Eight may include a receiver for a firearm, the receiver comprising a receiver housing defining an internal region; a receiver cover to be mounted on the receiver housing, and which is moveable relative to the receiver housing between an operating position to cover the internal region, and a non-operating position to at least partially expose the internal region and thereby facilitate access to the internal region; a first locking assembly to facilitate, when the receiver cover is mounted on the receiver housing, a first connection between the receiver housing and the receiver cover at a first region of the receiver; and a second locking assembly to facilitate, when the receiver cover is mounted on the receiver housing, a second connection of the receiver housing and the receiver cover at a second region of the receiver.

Example Nine may include the receiver of Example Eight, wherein the first locking assembly comprises a first receiver housing recess to extend in a direction of a longitudinal axis of the receiver housing and a second receiver housing recess to extend in a direction perpendicular to the longitudinal axis of the receiver housing.

Example Ten may include the receiver of Example Nine, wherein the first locking assembly comprises a first locking fastener to extend from the receiver cover for receipt into the first receiver housing recess when the receiver cover is mounted in the operating position on the receiver housing.

Example Eleven may include the receiver of Example Ten, wherein the first locking assembly comprises a second locking fastener for receipt into the second receiver housing recess when the receiver cover is mounted in the operating position on the receiver housing.

Example Twelve may include the receiver of Example Eleven, wherein the first locking fastener is selectively adjustably moveable relative to the receiver cover to thereby adjust the position of the receiver cover relative to the receiver housing.

Example Thirteen may include the receiver of Example Eight, wherein the second locking assembly comprises a receiver housing stop arranged at a distal end of the receiver housing.

Example Fourteen may include the receiver of Example Thirteen, wherein the second locking assembly comprises a receiver cover stop arranged at a distal end of the receiver cover, and which is to engage the receiver housing stop to thereby facilitate the first connection.

Example Fifteen may include the receiver of Example Eight, wherein the receiver housing or the receiver cover comprises a picatinny rail.

Example Sixteen may include the firearm, comprising: a firearm body; and a receiver for connection to the firearm, the receiving including: (i) a receiver housing defining an internal region to receive a bolt mechanism; (ii) a receiver cover for removeable connection to the receiver housing; (iii) a first locking assembly to facilitate, when the receiver cover is mounted on the receiver housing, a first connection of the receiver housing and the receiver cover at a forward region of the receiver; and (iv) a second locking assembly to facilitate, when the receiver cover is mounted on the receiver housing, a second connection of the receiver housing and the receiver cover at a rear region of the receiver.

Example Seventeen may include the firearm of Example Sixteen, a first receiver housing recess to extend in a direction of a longitudinal axis of the receiver housing; a second receiver housing recess to extend in a direction perpendicular to the longitudinal axis of the receiver housing; a first locking fastener to extend from the receiver cover for receipt into the first receiver housing recess when the receiver cover is mounted in the operating position on the receiver housing; and a second locking fastener for receipt into the second receiver housing recess when the receiver cover is mounted in the operating position on the receiver housing to thereby fix the cover in the operating position.

Example Eighteen may include the firearm of Example Seventeen, wherein the first locking fastener is selectively adjustably moveable relative to the receiver cover to thereby selectively adjust the position of the receiver cover relative to the receiver housing.

Example Nineteen may include the firearm of Example Sixteen, wherein the second locking assembly comprises: a receiver housing stop arranged at a distal end of the receiver housing; and a receiver cover stop arranged at a distal end of the receiver cover, and which is to engage the receiver housing stop to thereby facilitate the first connection.

Example Twenty may include the firearm of Example Sixteen, wherein the first locking assembly and the second locking assembly, when in a locked state respectively, permits the receiver cover to absorb some of the force of the bolt mechanism during firing of the firearm.

The terms "coupled," "attached," or "connected" may be used herein to refer to any type of relationship, direct or indirect, between the components in question, and may apply to electrical, mechanical, fluid, optical, electromagnetic, electromechanical or other connections. In addition, the terms "first," "second," etc. are used herein only to facilitate discussion, and carry no particular temporal or chronological significance unless otherwise indicated.

Those skilled in the art will appreciate from the foregoing description that the broad techniques of the embodiments can be implemented in a variety of forms. Therefore, while the embodiments have been described in connection with particular examples thereof, the true scope of the embodiments should not be so limited since other modifications will become apparent to the skilled practitioner upon a study of the drawings, specification, and following claims.

What is claimed is:

1. A receiver for a firearm, the receiver comprising:

a receiver housing defining an internal region;

a receiver cover to be mounted on the receiver housing;

a guide assembly that permits movement of the receiver cover relative to the receiver housing between an operating position to cover the internal region, and a non-operating position to at least partially expose the internal region and thereby facilitate access to the internal region;

a first locking assembly to facilitate, when the receiver cover is mounted on the receiver housing, a first connection of the receiver housing and the receiver cover at a first region of the receiver housing, the first locking assembly including a first receiver housing recess to extend in a direction of a longitudinal axis of the receiver housing, a second receiver housing recess to extend in a direction perpendicular to the longitudinal axis of the receiver housing, a first locking fastener to extend from the receiver cover for receipt into the first receiver housing recess when the receiver cover is mounted in the operating position on the receiver housing, and a second locking fastener for receipt into the second receiver housing recess when the receiver cover is mounted in the operating position on the receiver housing; and a second locking assembly to facilitate, when the receiver cover is mounted on the receiver housing, a second connection of the receiver housing and the receiver cover at a second region of the receiver.

2. The receiver of claim 1, wherein the first locking fastener is selectively adjustably moveable relative to the receiver cover to thereby adjust the position of the receiver cover relative to the receiver housing.

3. The receiver of claim 1, wherein the second locking assembly comprises:

a receiver housing stop arranged at a distal end of the receiver housing; and a receiver cover stop arranged at a distal end of the receiver cover, and which is to engage the receiver housing stop to thereby facilitate the first connection.

4. The receiver of claim 1, wherein the guide assembly comprises:

grooves arranged at an upper region of the receiver housing; and rails on both sides of the receiver cover, and which are to be received into the grooves to facilitate movement of the receiver cover relative to the receiver housing in a direction parallel to the longitudinal axis of the receiver cover.

5. The receiver of claim 4, wherein receipt of the rails into the grooves are to prevent movement of the receiver cover relative to the receiver housing in a direction perpendicular to the longitudinal axis of the receiver cover.

6. The receiver of claim 1, wherein the receiver housing or the receiver cover comprises a picatinny rail.

7. A receiver for a firearm, the receiver comprising:

a receiver housing defining an internal region;

a receiver cover to be mounted on the receiver housing, and which is moveable relative to the receiver housing between an operating position to cover the internal region, and a non-operating position to at least partially expose the internal region and thereby facilitate access to the internal region;

a first locking assembly to facilitate, when the receiver cover is mounted on the receiver housing, a first connection between the receiver housing and the receiver cover at a first region of the receiver housing, the first locking assembly including a first receiver housing recess to extend in a direction of a longitudinal axis of the receiver housing, a second receiver housing recess to extend in a direction perpendicular to the longitudinal axis of the receiver housing, a first locking fastener to extend from the receiver cover for receipt into the first receiver housing recess when the receiver cover is mounted in the operating position on the receiver housing, and a second locking fastener for receipt into the second receiver housing recess when the receiver cover is mounted in the operating position on the receiver housing; and a second locking assembly to facilitate, when the receiver cover is mounted on the receiver housing, a second connection of the receiver housing and the receiver cover at a second region of the receiver.

8. The receiver of claim 7, wherein the first locking fastener is selectively adjustably moveable relative to the receiver cover to thereby adjust the position of the receiver cover relative to the receiver housing.

9. The receiver of claim 7, wherein the second locking assembly comprises a receiver housing stop arranged at a distal end of the receiver housing.

10. The receiver of claim 9, wherein the second locking assembly comprises a receiver cover stop arranged at a distal end of the receiver cover, and which is to engage the receiver housing stop to thereby facilitate the first connection.

11. The receiver of claim 7, wherein the receiver housing or the receiver cover comprises a picatinny rail.

12. A firearm, comprising:

a firearm body; and a receiver for connection to the firearm, the receiving including:

a receiver housing defining an internal region to receive a bolt mechanism;

a receiver cover for removeable connection to the receiver housing;

a first locking assembly to facilitate, when the receiver cover is mounted on the receiver housing, a first connection of the receiver housing and the receiver cover at a forward region of the receiver housing, the first locking assembly including a first receiver housing recess to extend in a direction of a longitudinal axis of the receiver housing, a second receiver housing recess to extend in a direction perpendicular to the longitudinal axis of the receiver housing, a first locking fastener to extend from the receiver cover for receipt into the first receiver housing recess when the receiver cover is mounted in an operating position on the receiver housing, and a second locking fastener for receipt into the second receiver housing recess when the receiver cover is mounted in the operating position on the receiver housing; and a second locking assembly to facilitate, when the receiver cover is mounted on the receiver housing, a second connection of the receiver housing and the receiver cover at a rear region of the receiver.

13. The firearm of claim 12, wherein the first locking fastener is selectively adjustably moveable relative to the receiver cover to thereby selectively adjust the position of the receiver cover relative to the receiver housing.

14. The firearm of claim 12, wherein the second locking assembly comprises:

a receiver housing stop arranged at a distal end of the receiver housing; and a receiver cover stop arranged at a distal end of the receiver cover, and which is to engage the receiver housing stop to thereby facilitate the first connection.

15. The firearm of claim 12, wherein the first locking assembly and the second locking assembly, when in a locked state respectively, permits the receiver cover to absorb some of the force of the bolt mechanism during firing of the firearm.

* * * * *